United States Patent [19]

Oster

[11] 4,427,864

[45] Jan. 24, 1984

[54] ELECTRICAL OUTLET SWITCH

[76] Inventor: Stanley M. Oster, 8120 NW. 73rd Ter., Tamarac, Fla. 33319

[21] Appl. No.: 423,455

[22] Filed: Sep. 24, 1982

Related U.S. Application Data

[63] Continuation of Ser. No. 61,636, Jul. 30, 1979, abandoned.

[51] Int. Cl.[3] ..... H01H 9/00

[52] U.S. Cl. ..... 200/330

[58] Field of Search ..... 200/302, 304, 329, 330, 200/333, 334, 331

[56] References Cited

U.S. PATENT DOCUMENTS

| | | | |
|---|---|---|---|
| 2,382,738 | 8/1945 | Moyses | 200/330 |
| 2,415,298 | 2/1947 | Linton | 200/333 |
| 2,515,820 | 7/1950 | Clark | 174/66 |
| 2,571,837 | 10/1951 | Coles | 200/330 |
| 2,712,582 | 7/1955 | Peretti | 200/330 |
| 3,041,430 | 6/1962 | Hults | 200/302 |
| 3,778,577 | 12/1973 | Fromknecht et al. | 200/333 |
| 4,105,884 | 8/1978 | Damsky | 200/331 |

FOREIGN PATENT DOCUMENTS

| | | | |
|---|---|---|---|
| 1363425 | 8/1974 | United Kingdom | 174/66 |

*Primary Examiner*—John W. Shepperd
*Attorney, Agent, or Firm*—Eugene F. Malin

[57] ABSTRACT

A functional and aesthetic switch plate providing an extension to a wall toggle switch. The switch plate not only provides a useful mechanical extension to a toggle switch, but has a sliding toggle switch lever extension member which covers its own wear marks and is of sturdy unibody construction. The sliding toggle switch lever extension member is connected to the reflecting rear surface of the base plate by sliding contact members positioned beyond the reflecting base edges to prevent chipping of the reflecting base edges.

2 Claims, 10 Drawing Figures

Fig.1.
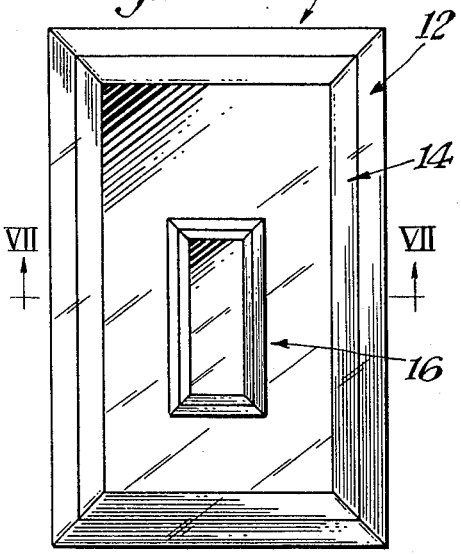
Fig.2.
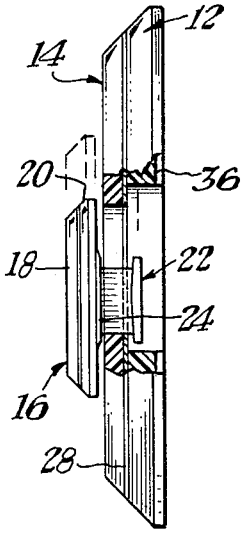
Fig.3.
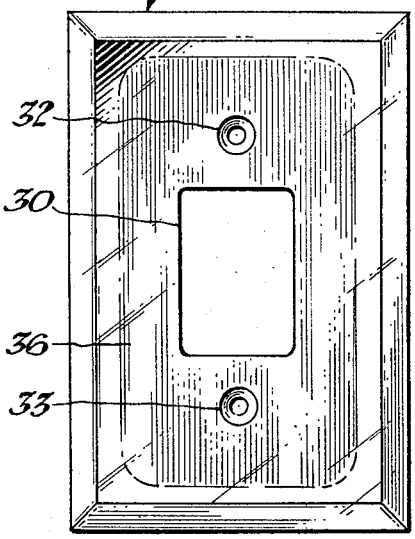
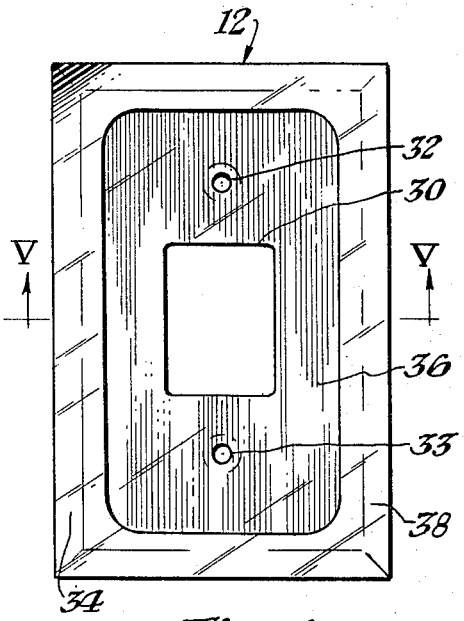
Fig.4.
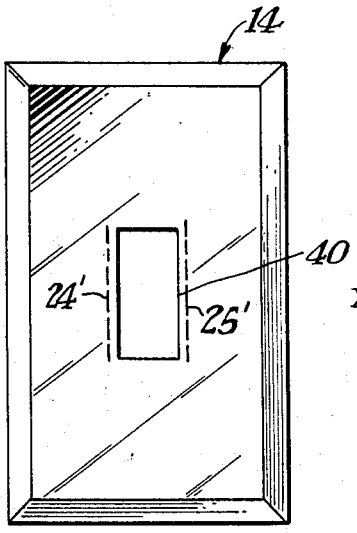
Fig.6.
Fig.5
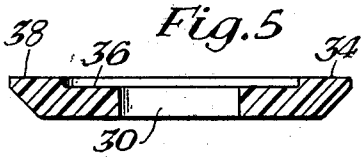
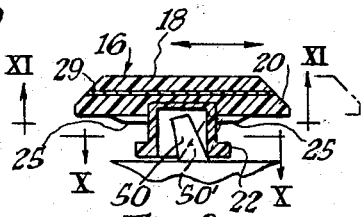
Fig.8.
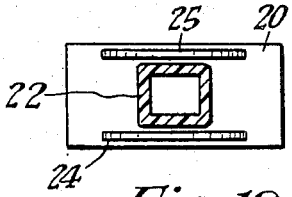
Fig.10.
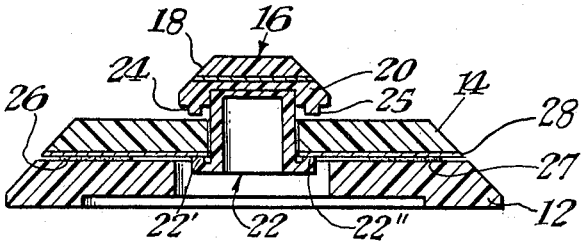
Fig.7.
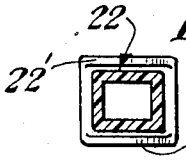
Fig.9.

ELECTRICAL OUTLET SWITCH

This is a continuation of Application Serial No. 061,636, filed July 30, 1979 now abandoned.

BACKGROUND OF THE INVENTION

In the past, there have been other toggle switch extension plates in the prior art, but the present invention provides a new and improved invention that is also aesthetically and functionally improved over the prior art. For instance, U.S. Pat. No. 2,571,837 is a toggle switch extension mechanism which is somewhat similar to that used in the present invention. But, the device described in U.S. Pat. No. 2,571,837 uses a spring mechanism to maintain the sliding toggle switch extension member flat against the base plate. Thus, when the switch extension is slid back and forth, it leaves wear marks.

The present invention differs from that invention in that it eliminates the use of a spring mechanism by making the toggle switch extension a single body, unlike the prior invention where the spring mechanism was riveted on. The present invention makes use of a pair of cams positioned in a particular manner to let only part of the sliding toggle switch extension member make contact with the base plate surface. The present invention is used for decorative purposes, as well as functional ones. The present mechanism is better than that of the prior art devices since the present mechanism covers its own cam wear lines of the sliding toggle switch lever extension. The front cam members of the sliding toggle switch lever extension make cam wear lines that are never visible to the users.

Furthermore, in one embodiment of the present invention where the switch plate is also a mirror for use with mirrored walls, the present mechanism uses rear sliding contact members or cams to make contact with the back reflective surface of the base plate. The cams are positioned to avoid making contact with the edges of the back reflecting surface. The positioning of the rear cams prevents chipping of the back reflecting surface; the prior mechanisms did not teach this new and improved structure. The sliding toggle switch extension member is a fixed member having a top and bottom that is wider than the opening in the base plate to insure proper positioning of the front and rear cams on the base plate.

SUMMARY OF THE INVENTION

The present invention is a functional switch plate which provides an extension to a wall toggle switch that provides a long lasting decorative switch plate. The switch plate provides a useful, one piece extension to a toggle switch. The one piece sliding toggle switch lever extension member includes a top and bottom having a width larger than the base plate opening. Top and bottom cam members are positioned on the base plate top and bottom surfaces respectively. The sliding toggle switch lever extension member is sized to cover its own wear marks from the top or upper cams. The sliding toggle switch lever extension member is of sturdy unibody construction. The sliding toggle switch lever extension member is connected to the reflecting rear surface of the base plate by sliding contact members or rear cams positioned beyond the reflective base edges to prevent chipping of the reflecting base edges.

It is an object of this invention to provide a switch plate extension to a toggle switch which has a sliding toggle switch lever extension of fixed uniconstruction design featuring upper cams fixed relative to the bottom cams.

It is another object of this invention to provide a switch plate-toggle switch extension that after repeated use will leave the base plate aesthetically as attractive as it was initially and more attractive than the prior art toggle switch-base plate devices.

It is another object of this invention to provide such a switch plate which uses a sliding extension to the toggle switch lever which does not reveal its own wear marks resulting from the friction contact between the upper cams of the sliding member and the top of the base plate.

It is still another object of the present invention to provide such a sliding toggle switch extension member of unibody construction which makes contact with the back reflecting side of the base plate in such a manner as to not chip a mirror finish along the edges of the back of the base plate.

In accordance with these and other objects which will be apparent hereinafter, the instant invention will now be described with particular reference to the accompanying drawings.

BRIEF DESCRIPTION OF THE DRAWINGS

FIG. 1 is an elevational front view of the switch plate assembly with toggle switch extension in a down position.

FIG. 2 is an elevational side view of FIG. 1 partially in cross-section showing the toggle switch in a down position and in phantom in an up position.

FIG. 3 is an elevational front view of the bottom plate showing the toggle switch opening as well as screw connecting holes covered by the base plate.

FIG. 4 is an elevational rear view of the bottom plate shown in FIG. 3.

FIG. 5 is a transverse cross-sectional view of the bottom plate taken along lines V—V in FIG. 4 and looking in the direction of the arrows showing the depression and the through hole or opening.

FIG. 6 is an elevational front view of the top or base plate without the toggle switch lever extension member in position on the plate.

FIG. 7 is a transverse cross-sectional view of the switch plate assembly shown in FIG. 1 taken along lines VII—VII and looking in the direction of the arrows.

FIG. 8 is a longitudinal cross-sectional view of the toggle switch lever extension member shown in place over the toggle switch lever.

FIG. 9 is a cross-sectional view of the trunk of the toggle switch lever extension member taken along lines X—X and looking in the direction of the arrows.

FIG. 10 is a cross-sectional view of the toggle switch lever extension member taken along lines XI—XI and looking in the direction of the arrows.

DESCRIPTION OF THE PREFERRED EMBODIMENT

Referring to FIGS. 1, 2, 7, and 10, a rectangular switch plate assembly 10 includes two plastic plates 12 and 14 and a toggle switch lever extension member 16. The two plates top or base plate 12 and bottom plate 14 and the switch lever extension member 16 are preferably made of transparent plastic, but may be colored plastic. Plate 12 is connected to plate 14 by adhesive strips shown at 26 and 27 in FIG. 7. The finish on all the front surfaces of the switch plate assembly is quite smooth and glossy.

The front plate 14 has a rear surface 28 made of a reflective material that reflects toward the front of the assembly. The front plate 14, the rear or bottom plate 12, and the toggle switch lever extension member 16 are all rectangular in shape with sloping peripheral edges.

The toggle switch lever extension member 16 comprises a one piece member including front rectangular plate 18 made of transparent plastic, the rear side of which includes a reflective material 29 that is reflective toward the front.

The toggle switch extension also includes a rear plate 20 which is also generally rectangular and whose front face is permanently attached to the front plate 18, that is the rear face of the front plate 29, the reflective surface by adhesive (not shown). A hollow, rectangular box-like structure 22, designed to enclose the toggle switch lever 50 as shown in FIG. 8, is permanently attached to the rear side of rear plate 20 by adhesive.

As shown in FIGS. 7, 8, and 10, the back side of the rear plate 20 of the switch lever extension member or toggle switch extension 16 has cams 24 and 25 which wears the surface of front plate 14 only along certain wear lines, illustrated by dashed lines 24' and 25' in FIG. 6. The cams 24 and 25 also serve the purpose of elevating the rest of the bottom plate 20 such that it does not wear the surface of top plate 14 except along the lines 24' and 25' worn by the cams 24 and 25 respectively. The toggle switch extension 16, bottom plate, or member 20 is designed in length to always cover up the wear lines left by the cams 24 and 25 such that they are not visible.

Referring to FIG. 7 the cams 24 and 25, and 22' and 22'' are shown close to the hole in the central portion of front plate 14. The cams are spaced from the hole as shown a distance less than the width of each of the cams 24, 25, 22' and 22''.

Now, referring to FIGS. 3, 4, and 5, the rear plate 12 of the switch plate assembly 10 acts as a spacer between the wall and member 14. Rear plate 12 has two through holes 32 and 33 for screws to connect the rear plate 12 to a wall. The rear plate 12 also has one rectangular hole 30 in its center in which the toggle switch extension 16 fits in order to engage toggle 50 shown in FIG. 8. The back side of rear plate 12, shown in FIGS. 4 and 5, has a generally rectangular indentation 36 whose surface finish is rougher than the rest of the back side to hide the electrical components connected to toggle 50. The front plate 14 of the switch plate assembly 10 has one rectangular through hole 40 in its center, shown in FIG. 6, through which the toggle switch extension 16 fits.

Referring to FIGS. 7, 8, 9, and 10, toggle switch extension 16 fits through holes 30 and 40. The back and forth motion of the toggle switch extension 16 moves the toggle switch lever 50 from "on" to "off" positions as shown in FIG. 8 at 50 and 50' in phantom.

The toggle switch extension 16 makes contact with the rear surface of the front plate 14 by two cams 22' and 22'', shown in FIGS. 7 and 9. This prevents chipping of the reflective surface 28 on the rear side of the front plate 14, since contact is avoided between the edge of hole 40 and cams 22' and 22'' by positioning. This positioning is assured by permanently contacting member 22 to member 20 in hole 40.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A reflective switch plate assembly, comprising:

a clear base plate with a through opening and a front surface and a rear surface;

a reflective material connected to said rear surface of said base plate;

a non-removable toggle switch lever extension means non-removably fixed in said opening for sliding reciprocal movement within said opening, said extension means having a front portion means with a rear side mid portion and a rear portion with a front side, said extension means for fitting over a toggle switch lever for controlling the position of the toggle switch lever by sliding said front portion means of said extension means back and forth over the surface of said base plate within said opening;

said extension means including two upper cams on said rear side of said front portion means for sliding contact with said front surface of said base plate of said switch plate assembly, said two cams causing wear marks on said front surface;

said front portion means for covering said wear marks in all positions and being larger in length than said two upper cams so that said wear marks left on said front surface of said base plate caused by friction of said two upper cams are covered;

said extension means having two lower cam means positioned on said front side of said rear portion, said two lower cam means positioned for movement against said reflective material on said surface of said base plate, said two lower cam means each having a width;

said two lower cam means positioned to make contact with the said reflective material spaced away from the sides of said opening a distance no greater than said width, said two lower cam means spaced from said opening and having said width for preventing chipping of said reflective material along said through opening for preventing visible marks;

said mid portion extends through said through opening and connecting said front portion means and said rear portion.

2. A switch plate assembly as set forth in claim 1, including:

a base plate assembly including said base plate and a second plate having a lower surface and an upper surface connected to said reflective material on said base plate;

said second plate and said base plate constructed of a transparent material;

said extension means consisting of at least two transparent plates, and reflective materials connected between said transparent plates;

said second plate including wall securing means;

said base plate covering said upper surface of said second plate.

* * * * *